US007849781B2

(12) United States Patent
White

(10) Patent No.: US 7,849,781 B2
(45) Date of Patent: Dec. 14, 2010

(54) BULLET RESISTANT BARRIER

(75) Inventor: Collins White, Syracuse, NY (US)

(73) Assignee: Defenshield, Inc., East Syracuse, NY (US)

( * ) Notice: Subject to any disclaimer, the term of this patent is extended or adjusted under 35 U.S.C. 154(b) by 0 days.

(21) Appl. No.: 11/160,079

(22) Filed: Jun. 8, 2005

(65) Prior Publication Data

US 2010/0011950 A1 Jan. 21, 2010

Related U.S. Application Data

(62) Division of application No. 10/243,508, filed on Sep. 14, 2002, now Pat. No. 6,907,811.

(60) Provisional application No. 60/361,768, filed on Mar. 5, 2002.

(51) Int. Cl.
*F41H 5/14* (2006.01)

(52) U.S. Cl. ..... 89/36.07; 89/36.09

(58) Field of Classification Search ..... 89/36.04, 89/36.07, 36.08, 36.09, 36.14, 36.15; 160/29, 160/30; 428/911
See application file for complete search history.

(56) References Cited

U.S. PATENT DOCUMENTS

| | | | | |
|---|---|---|---|---|
| 772,055 | A | 10/1904 | Post | |
| 1,253,964 | A | 1/1918 | Hack | |
| 1,261,518 | A | 4/1918 | Hahre | |
| 1,274,721 | A | 8/1918 | Krzan | |
| 1,281,400 | A | 10/1918 | Larnell | |
| 1,465,042 | A | 8/1923 | Hruska | |
| 1,875,488 | A * | 9/1932 | Peters | 109/17 |
| 2,370,596 | A | 2/1945 | Wallace | |
| 2,613,243 | A | 10/1952 | Frear | |
| 2,845,153 | A * | 7/1958 | West | 49/371 |
| 2,985,174 | A | 5/1961 | Guth | |
| 3,039,161 | A | 6/1962 | Gagnon | |
| 3,590,685 | A | 7/1971 | Lane | |
| 3,712,005 | A | 1/1973 | Eschbach et al. | |
| 3,942,598 | A * | 3/1976 | Council | 180/6.5 |
| 3,994,243 | A | 11/1976 | Anders | |
| 4,030,219 | A | 6/1977 | Donovan | |
| 4,061,093 | A * | 12/1977 | Carstens et al. | 109/19 |

(Continued)

FOREIGN PATENT DOCUMENTS

DE 64291 C 2/1892

(Continued)

OTHER PUBLICATIONS

Attachment 1; 2 pages; pp. 9/14 and 11/14 with examiners labeling of WO 94/29665.*

*Primary Examiner*—Stephen M Johnson
(74) *Attorney, Agent, or Firm*—Woodcock Washburn LLP

(57) ABSTRACT

A barrier comprising a base unit composed of a bullet resistant material and a transparent upper wall removably interconnected to the base unit and composed of a bullet resistant material. The base unit includes a front wall and two side walls extending from the front wall to provide protection to the front and sides of a person standing behind the barrier. A series of casters, preferably locking casters, are attached to the bottom edges of the side walls, and a pair of handles connected to each of the side walls permitting the barrier to be conveniently transported from one site to another.

14 Claims, 5 Drawing Sheets

U.S. PATENT DOCUMENTS

| | | | | | |
|---|---|---|---|---|---|
| 4,245,546 | A | | 1/1981 | Chaires | |
| 4,351,558 | A | * | 9/1982 | Mueller | 296/203.01 |
| 4,416,485 | A | * | 11/1983 | Long | 296/187.03 |
| 4,674,394 | A | * | 6/1987 | Martino | 89/36.05 |
| 4,781,101 | A | | 11/1988 | Zevuluni et al. | |
| 4,901,964 | A | | 2/1990 | McConnell | |
| 4,949,490 | A | | 8/1990 | Miller | |
| 4,953,820 | A | | 9/1990 | Yoder | |
| 5,244,172 | A | | 9/1993 | Allega | |
| 5,293,807 | A | | 3/1994 | Hajdu | |
| 5,368,904 | A | * | 11/1994 | Stephinson | 428/34 |
| 5,419,479 | A | | 5/1995 | Evels et al. | |
| 5,438,908 | A | | 8/1995 | Madden, Jr. | |
| 5,560,149 | A | * | 10/1996 | Lafevre | 49/501 |
| 5,666,773 | A | * | 9/1997 | Librande et al. | 52/202 |
| 5,703,316 | A | | 12/1997 | Madden, Jr. | |
| 5,857,730 | A | * | 1/1999 | Korpi et al. | 296/146.1 |
| 5,878,519 | A | | 3/1999 | Huyck et al. | |
| 6,000,347 | A | | 12/1999 | Madden, Jr. | |
| 6,116,326 | A | * | 9/2000 | Domina et al. | 160/351 |
| 6,333,085 | B1 | | 12/2001 | Emek | |
| 6,622,607 | B1 | * | 9/2003 | Miller | 89/36.07 |
| 6,907,811 | B2 | | 6/2005 | White | |
| 6,962,461 | B2 | | 11/2005 | Choi et al. | |
| 7,069,680 | B1 | | 7/2006 | Crawford | |
| 7,128,308 | B2 | | 10/2006 | Marsh et al. | |
| 2003/0167911 | A1 | | 9/2003 | White | |
| 2006/0000671 | A1 | | 1/2006 | Nolley | |

FOREIGN PATENT DOCUMENTS

| | | | |
|---|---|---|---|
| DE | 2412568 | | 9/1975 |
| FR | 462049 | | 1/1914 |
| FR | 2607238 | | 5/1988 |
| WO | WO 94/29665 | * | 12/1994 |

* cited by examiner 18
48
46
42
40
24
38
28
22
26
20
26
16
34
28

18
48
10
42
5
42
46
32
5
44
38
34
28
36
30
26
16
28
1
26

BULLET RESISTANT BARRIER

CROSS-REFERENCE TO RELATED APPLICATION

The present application is a divisional of and claims priority to U.S. Non-provisional patent application Ser. No. 10/243,508, filed on Sep. 14, 2002, now U.S. Pat. No. 6,907,811, which claimed priority to U.S. Provisional Patent Application Ser. No. 60/361,768, filed on Mar. 5, 2002.

BACKGROUND OF THE INVENTION

The present invention relates generally to bullet resistant barriers, and more particularly to such barriers that are portable.

There are many locations and situations where law enforcement/security personnel or others, such as workers in financial institutions, are regularly placed in harm's way. If the individuals are located in the same station everyday, that station may be equipped with bullet resistant properties to protect the occupant. However, in situations when the personnel must be mobile or move to various locations, it would be useful to have some bullet resistant barrier that could be moved with them. In addition, it would be useful for such a barrier to provide bullet resistant coverage to the personnel's entire body.

It is therefore a principal object and advantage of the present invention to provide a bullet resistant barrier that is movable.

It is a further object and advantage of the present invention to provide a bullet resistant barrier that provides protection to the entire body of an occupant.

It is an additional object and advantage of the present invention to provide a bullet resistant barrier that may be broken down for ease of transport.

Other objects and advantages of the present invention will in part be obvious, and in part appear hereinafter.

SUMMARY OF THE INVENTION

In accordance with the foregoing objects and advantages, the present invention contemplates a barrier comprising a base unit composed of a bullet resistant material, such as metal, plastic, ceramic or a composite material, and a transparent upper wall removably interconnected to the base unit and composed of a bullet resistant material, such as a bullet resistant plastic or glass. The base unit includes a front wall and two side walls extending from the front wall to provide protection to the front and sides of a person standing behind the barrier. A series of casters, preferably locking casters, are attached to the bottom edges of the side walls, and a pair of handles are connected to each of the side walls permitting the barrier to be conveniently transported from one site to another.

A bracket assembly comprising first and second upstanding channel members interconnected by an S-shaped double channel member extending transversely there between serves to removably interconnect the upper wall to the base unit. The S-shaped member hooks over the upper edge of the front wall with its lower channel being positioned to receive the bottom edge of the upper wall. The two upstanding channel members are positioned at opposite ends of the S-shaped member and engage the opposite side edges of the upper wall. The upper wall may be slid into or out of engagement with this bracket assembly, thereby facilitating convenient break-down of the barrier.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
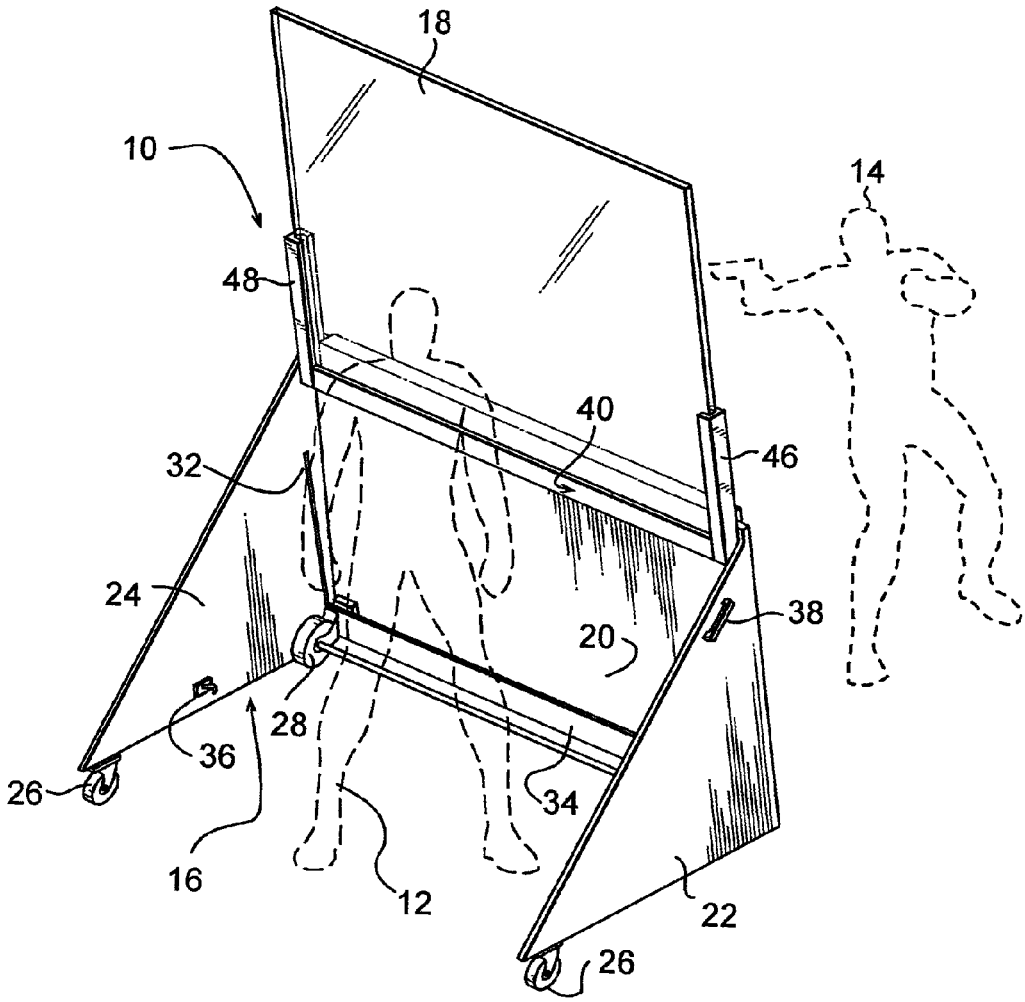
FIG. 1 is a perspective view illustrating use of the present invention.
Figure 2:
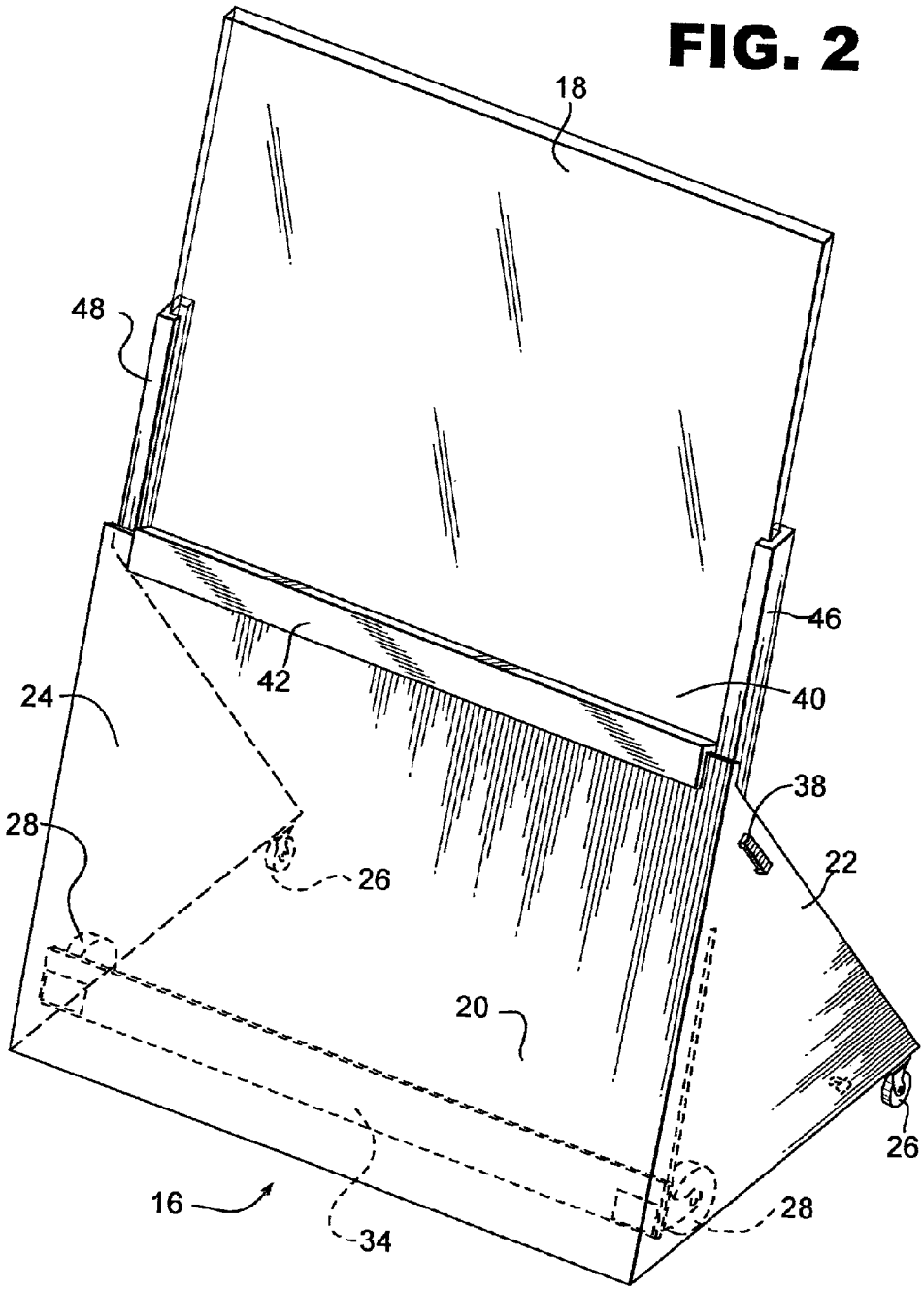
FIG. 2 is a front perspective view of the present invention.
Figure 3:
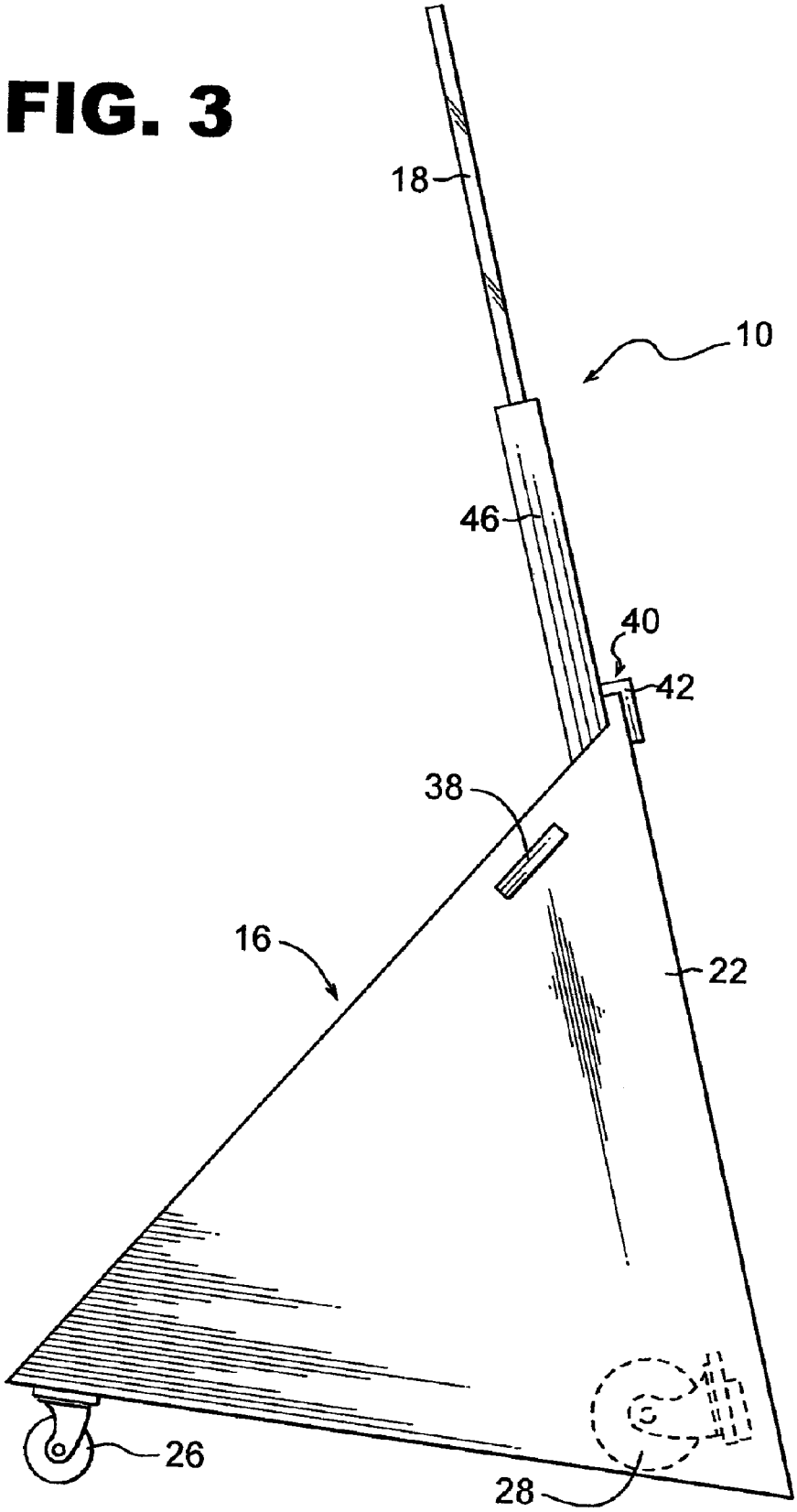
FIG. 3 is a side elevation view of the present invention.
Figure 4:
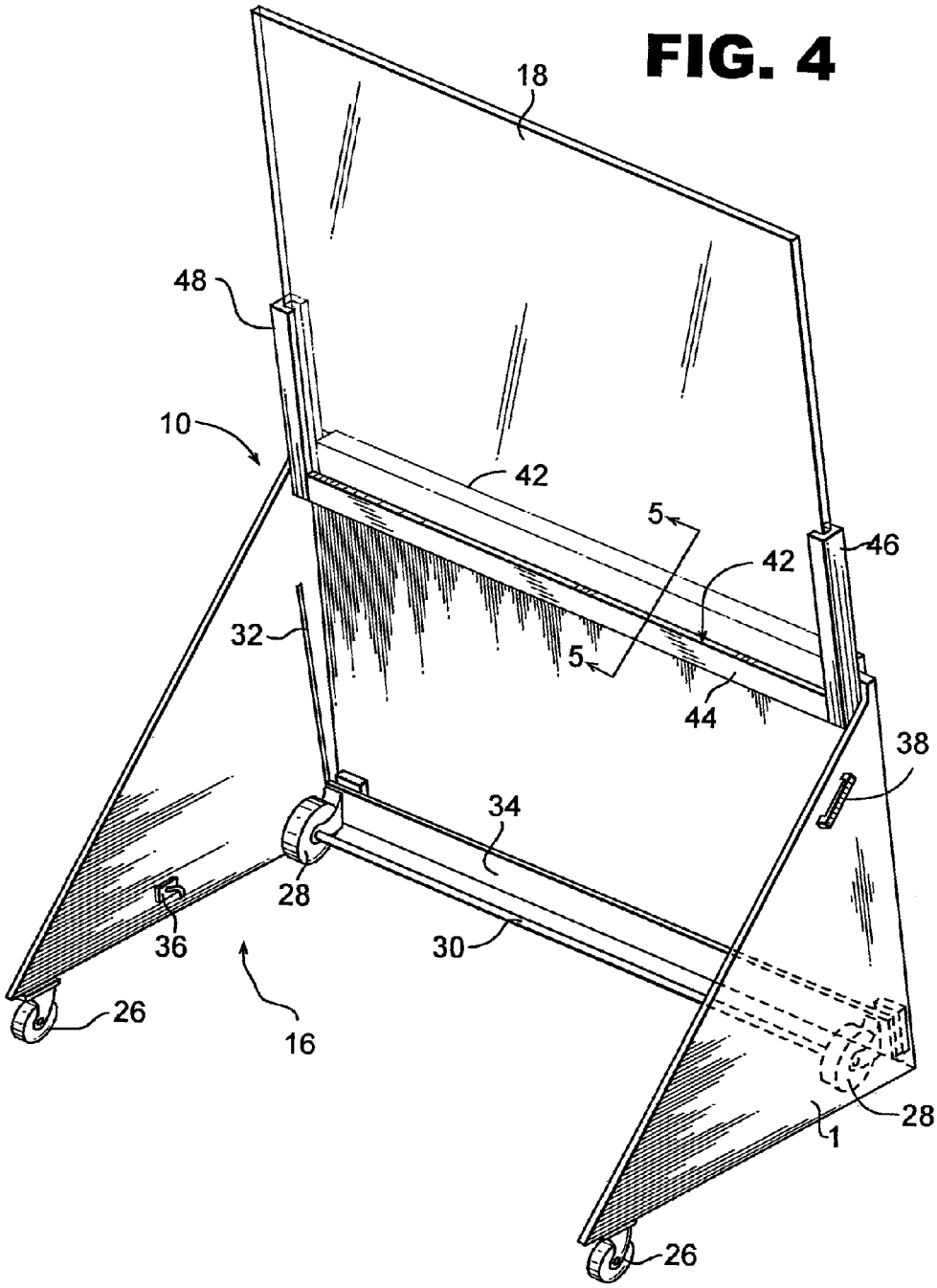
FIG. 4 is a rear perspective view of the present invention.

Referring now to the drawings, wherein like reference numerals refer to like parts throughout, there is seen in FIG. 1 a barrier device designated generally by reference numeral 10, designed to protect personnel (a "target") 12 from the gunshots of a perpetrator (a "source") 14. Barrier 10 generally comprises a base unit 16 and a transparent, upper wall 18 removably interconnected to the base unit, both of which are composed of bullet resistant materials (for instance, base unit 16 may be composed of metal, plastic, ceramic or a composite material, and upper wall 18 may be composed of Bullet resisting Plastic or Glass).

Base unit 14 comprises a front wall 20 and two side walls 22, 24 which extend perpendicularly rearward from opposing side edges of front wall 20. A first pair of casters 26 are connected to the bottom edges of side walls 22, 24, and a second pair of casters 28 interconnected to one another by an axle 30 are pivotally attached to front wall 20 in order to be movable into or out of engagement with the ground. A rod 32 and locking bar 34 may be used by "target" 12 to lock/unlock casters 28 and pivotally move them into or out of engagement with the ground (rod 32 may be snap engaged into bracket 36 mounted to the interior surface of side wall 24 to lock casters 28 in engaging relation with the ground). To assist in moving barrier 10, handles 38 are mounted to the exterior surfaces of side walls 22, 24 for grasping by the person moving the unit.

Figure 5:
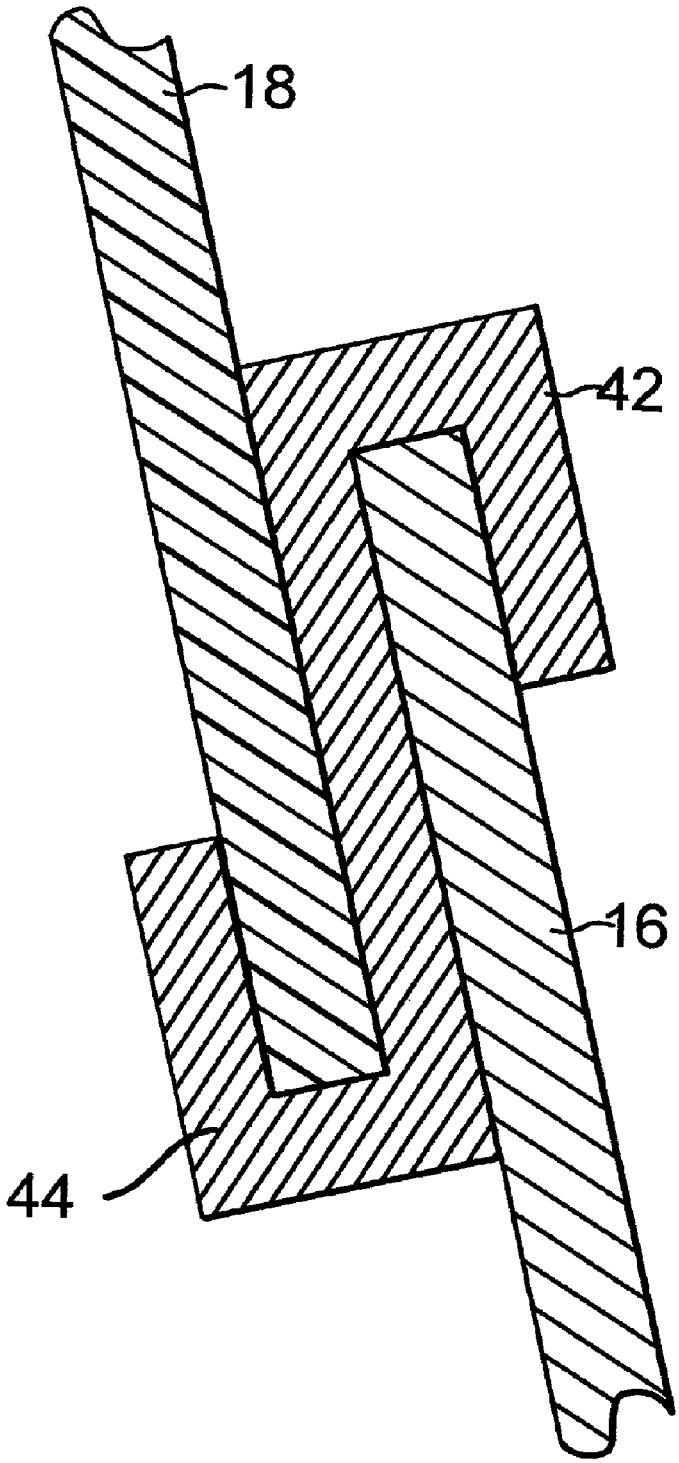
FIG. 5 is a cross-sectional view taken along line 5-5 of FIG. 4.

A bracket assembly is provided to interconnect upper wall 18 to base unit 16. The bracket assembly comprises an S-shaped member 40 that extends along a longitudinal axis and includes an upper channel member 42 that engages the upper edge of front wall 20, and a lower channel member 44 in which the bottom edge of upper wall 18 is positioned (alternatively, this member could simply comprise lower channel 44 attached to or integrally formed with front wall 20), as illustrated in FIG. 5. A pair of upstanding channel members 46, 48 are attached to (or could be integral with) base unit 16 and positioned at opposite ends of S-shaped member 40, and extend along respective longitudinal axes that are parallel to one another and essentially perpendicular to the axis along which S-shaped member 40 extends. The opposing side edges of upper wall 18 engage channel members 46, 48, respectively, thereby slidably and removably interconnecting upper wall 18 to base unit 16.

What is claimed is:

1. A barrier for placement on a supporting surface, the barrier comprising:

a freestanding base assembly comprising a front wall extending in a substantially upward direction relative to the supporting surface, the front wall having an upper edge remote from the supporting surface;

a bracket mechanically coupled to the front wall and comprising a first channel, the first channel positioned below the upper edge of the front wall a side channel formed at an angle relative to the first channel and extending upward beyond the upper edge of the front wall; and an upper wall comprising at least a portion that is substantially transparent and ballistic resistant, the upper wall having a lower edge, at least a portion of the lower edge received in the first channel and a second portion of the upper wall received in the side channel, wherein the upper wall extends upward from the first channel, the lower edge of the upper wall is positioned below the upper edge of the front wall, and a portion of the upper wall overlaps with the front wall, and further wherein the upper wall is movable relative to the first channel and removable from the base assembly by movement of the upper wall away from the first channel.

2. The barrier of claim 1 wherein the freestanding base assembly is made at least substantially out of a ballistic resistant material.

3. The barrier of claim 1 wherein the freestanding base assembly further comprises:

a first side wall extending at an angle from the front wall; and a second side wall extending at an angle from the front wall.

4. The barrier of claim 1 wherein the freestanding base assembly comprises a plurality of wheels located, sized and connected so that the base assembly can roll along the supporting surface.

5. The barrier of claim 1 wherein the upper wall is slidably removable from the freestanding base assembly.

6. The barrier of claim 1 wherein the upper wall comprises a surface that is substantially planar.

7. The barrier of claim 1 wherein the upper wall is at an angle from the vertical when the barrier is supported by the supporting surface in the upright position.

8. The barrier of claim 1 wherein a height of the barrier as measured from the supporting surface is sufficient to protect an entire body of a person situated behind the barrier.

9. A moveable barrier for placement on a supporting surface, the barrier comprising:

a freestanding base assembly comprising a front wall extending in a substantially upward direction relative to the supporting surface, the front wall having an upper edge remote from the supporting surface;

a plurality of wheels mechanically coupled to the freestanding base assembly and positioned proximate a bottom of the freestanding base assembly, the plurality of wheels adapted for rolling on the supporting surface;

a bracket mechanically coupled to the front wall and comprising a first channel, the first channel positioned below the upper edge of the front wall;

a side channel formed at an angle relative to the first channel and extending upward beyond the upper edge of the front wall; and an upper wall comprising at least a portion that is substantially transparent through, and ballistic resistant, the upper wall having a lower edge, at least a portion of the lower edge received in the first channel and a second portion of the upper wall received in the side channel, wherein the upper wall extends upward from the first channel, the lower edge of the upper wall is positioned below the upper edge of the front wall, and a portion of the upper wall overlaps the front wall, and further wherein the upper wall is movable relative to the first channel and removable from the base assembly by movement of the upper wall away from the first channel.

10. The barrier of claim 9 wherein at least some of the plurality of wheels are in the form of casters.

11. The barrier of claim 9 wherein a height of the barrier is sufficient to protect an entire body of a person situated behind the barrier.

12. A barrier for placement on a supporting surface, the barrier comprising:

a front wall extending in a substantially upward direction relative to the supporting surface, the front wall having an upper edge remote from the supporting surface;

a first side wall coupled to the front wall and formed at an angle relative to the front wall;

a second side wall coupled to the front wall and formed at an angle relative to the front wall;

a bracket mechanically coupled to the front wall and comprising a first channel, the first channel positioned below the upper edge of the front wall;

a side channel formed at an angle relative to the first channel and extending upward beyond the edge of the front wall; and an upper wall comprising at least a portion that is substantially transparent and ballistic resistant, the upper wall having a lower edge, at least a portion of the lower edge received in the first channel and a second portion of the upper wall received in the side channel, wherein the upper wall extends upward from the first channel, the lower edge of the upper wall is positioned below the upper edge of the front wall, and a portion of the upper wall overlaps with the front wall, and further wherein the upper wall is movable relative to the first channel and removable from the barrier by movement of the upper wall away from the first channel.

13. The barrier of claim 12 wherein:

the first channel is generally U-shaped in cross-section.

14. The barrier of claim 13 wherein:

the bracket has a generally S-shaped cross-section and the first channel receives an edge of the upper wall and a second portion receives an edge of the front wall.

* * * * *